US008820899B2

(12) United States Patent
Hoisington et al.

(10) Patent No.: US 8,820,899 B2
(45) **Date of Patent: *Sep. 2, 2014**

(54) APPARATUS FOR FLUID DROPLET EJECTION HAVING A RECIRCULATION PASSAGE

(71) Applicant: FUJIFILM Corporation, Tokyo (JP)

(72) Inventors: Paul A. Hoisington, Hanover, NH (US); Mats G. Ottosson, Saltsjo-Boo (SE); Tadashi Kyoso, San Jose, CA (US); Kanji Nagashima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/955,834

(22) Filed: Jul. 31, 2013

(65) Prior Publication Data

US 2014/0036001 A1 Feb. 6, 2014

Related U.S. Application Data

(62) Division of application No. 12/991,591, filed as application No. PCT/US2009/044868 on May 21, 2009, now Pat. No. 8,534,807.

(60) Provisional application No. 61/055,894, filed on May 23, 2008.

(51) Int. Cl.
*B41J 2/17* (2006.01)

(52) U.S. Cl.
USPC ..... 347/84; 347/68; 347/89

(58) Field of Classification Search
USPC ..... 347/20, 65, 66, 68, 71–72, 84–87, 89
See application file for complete search history.

(56) References Cited

U.S. PATENT DOCUMENTS 4,835,554 A 5/1989 Hoisington et al.
5,771,052 A 6/1998 Hine et al.

(Continued)

FOREIGN PATENT DOCUMENTS

CN 1603116 A 4/2005
EP 0 736 390 9/1996

(Continued)

OTHER PUBLICATIONS

Rejection Decision, mailed Sep. 3, 2013 in corresponding Chinese Patent Application No. 200980117680.2, 13 pgs.

(Continued)

*Primary Examiner* — Juanita D Jackson
(74) *Attorney, Agent, or Firm* — Fish & Richardson P.C.

(57) ABSTRACT

A system for ejecting droplets of a fluid is described. The system includes a substrate having a flow path body that includes a fluid pumping chamber, a descender fluidically connected to the fluid pumping chamber, and a nozzle fluidically connected to the descender. The nozzle is arranged to eject droplets of fluid through an outlet formed in an outer substrate surface. The flow path body also includes a recirculation passage fluidically connected to the descender. The system for ejecting droplets of a fluid also includes a fluid supply tank fluidically connected to the fluid pumping chamber, a fluid return tank fluidically connected to the recirculation passage, and a pump fluidically connecting the fluid return tank and the fluid supply tank. In some implementations, a flow of fluid through the flow path body is at a flow rate sufficient to force air bubbles or contaminants through the flow path body.

12 Claims, 8 Drawing Sheets

(56) References Cited

U.S. PATENT DOCUMENTS

| | | | | |
|---|---|---|---|---|
| 6,074,035 | A | 6/2000 | Irizawa et al. | |
| 6,886,924 | B2 | 5/2005 | Hasenbein et al. | |
| 7,128,404 | B2 | 10/2006 | Kodama | |
| 7,128,406 | B2 | 10/2006 | Dixon et al. | |
| 7,309,119 | B2 | 12/2007 | Kojima | |
| 7,513,041 | B2 | 4/2009 | Ito et al. | |
| 7,823,288 | B2 | 11/2010 | Ito et al. | |
| 7,971,981 | B2 * | 7/2011 | Nagashima et al. | 347/89 |
| 8,534,807 | B2 * | 9/2013 | Hoisington et al. | 347/84 |
| 2002/0051039 | A1 | 5/2002 | Moynihan et al. | |
| 2006/0028503 | A1 | 2/2006 | Yamazaki et al. | |
| 2007/0046736 | A1 | 3/2007 | Katayama et al. | |
| 2007/0091150 | A1 | 4/2007 | Kodama | |
| 2008/0030553 | A1 | 2/2008 | Takahashi | |
| 2008/0055378 | A1 | 3/2008 | Drury et al. | |

FOREIGN PATENT DOCUMENTS

| | | |
|---|---|---|
| JP | 08-267732 | 10/1996 |
| JP | 11-058741 | 3/1999 |
| JP | 2002210965 | 7/2002 |
| JP | 2006-088151 | 4/2006 |
| JP | 2007-118309 | 5/2007 |
| JP | 200626953 | 9/2007 |
| WO | 2009/143362 | 11/2009 |

OTHER PUBLICATIONS

International Search Report and Written Opinion dated Jul. 23, 2009 issued in international application No. PCT/US2009/044868, 10 pgs.

Laurell et al., "Design and development of a silicon microfabricated flow-through dispenser for on-line picolitre sample handling," J.Micromech.Microeng. 9:369-76 (1999).

International Preliminary Report on Patentability dated Dec. 2, 2010 issued in international application No. PCT/US2009/044868, 9 pgs.

Office action issued Dec. 3, 2012 from corresponding Chinese Application No. 200980117680.2 and uncertified English translation, 18 pgs.

Office action issued Jul. 2, 2013 from corresponding Japanese Application No. 2011-510707, 6 pgs.

* cited by examiner

APPARATUS FOR FLUID DROPLET EJECTION HAVING A RECIRCULATION PASSAGE

This application is a division of U.S. National Phase Application Ser. No. 12/991,591, filed on Mar. 1, 2011, which claims the benefit under 35 U.S.C. §371 of International Patent Application No. PCT/US2009/044868, filed on May 21, 2009, which claims the benefit of U.S. Provisional Patent Application Ser. No. 61/055,894, filed on May 23, 2008, the contents of which are hereby incorporated by reference in their entireties.

BACKGROUND

This invention relates to fluid ejection devices. In some fluid ejection devices, fluid droplets are ejected from one or more nozzles onto a medium. The nozzles are fluidically connected to a fluid path that includes a fluid pumping chamber. The fluid pumping chamber can be actuated by an actuator, which causes ejection of a fluid droplet. The medium can be moved relative to the fluid ejection device. The ejection of a fluid droplet from a particular nozzle is timed with the movement of the medium to place a fluid droplet at a desired location on the medium. In these fluid ejection devices, it is usually desirable to eject fluid droplets of uniform size and speed and in the same direction in order to provide uniform deposition of fluid droplets on the medium.

SUMMARY

In one aspect, the systems, apparatus, and methods described herein include a system for ejecting droplets of a fluid that includes a substrate. The substrate can include a flow path body having a fluid path formed therein. The fluid path can include a fluid pumping chamber, a descender fluidically connected to the fluid pumping chamber, and a nozzle fluidically connected to the descender. The nozzle can be arranged to eject droplets of fluid through an outlet formed in an outer nozzle layer surface. A recirculation passage can be fluidically connected to the descender and can be closer to the nozzle than the pumping chamber. A fluid supply tank can be fluidically connected to the fluid pumping chamber. A fluid return tank can be fluidically connected to the recirculation passage. A pump can be configured to fluidically connect the fluid return tank and the fluid supply tank.

In another aspect, an apparatus for ejecting droplets of a fluid can include a substrate having a fluid pumping chamber formed therein. A descender can be formed in the substrate and fluidically connected to the fluid pumping chamber. An actuator can be in pressure communication with the fluid pumping chamber. A nozzle can be formed in the substrate and can be fluidically connected to the descender. The nozzle can have an outlet for ejecting droplets of fluid, and the outlet can be formed in an outer substrate surface. A recirculation passage can be formed in the substrate and fluidically connected to the descender at a position such that a distance between the outer substrate surface and a closest surface of the recirculation passage is less than or about 10 times a width of the outlet, and the recirculation passage can be not fluidically connected to a different fluid pumping chamber.

In another aspect, an apparatus for ejecting droplets of a fluid can include a substrate having a fluid pumping chamber formed therein, a descender formed in the substrate and fluidically connected to the fluid pumping chamber, and an actuator in pressure communication with the fluid pumping chamber. A nozzle can be formed in the substrate and fluidically connected to the descender. The nozzle can have an outlet for ejecting droplets of fluid, and the outlet can be formed in an outer substrate surface. A recirculation passage can be formed in the substrate and fluidically connected to the descender, and the recirculation passage can be not fluidically connected to a different fluid pumping chamber. The nozzle can have an opening opposite the outlet and a tapered portion between the nozzle opening and the outlet. A surface of the recirculation passage that is proximate the nozzle can be substantially flush with the nozzle opening.

In another aspect, an apparatus for ejecting droplets of a fluid can include a substrate having a fluid pumping chamber formed therein, a descender formed in the substrate and fluidically connected to the fluid pumping chamber, and a nozzle formed in the substrate and fluidically connected to the descender, the nozzle having an outlet for ejecting droplets of a fluid, the outlet being coplanar with an outer substrate surface. Two recirculation passages can also be arranged symmetrically around, and fluidically connected to, each descender.

In another aspect, an apparatus for ejecting droplets of a fluid can include a substrate having a fluid pumping chamber formed therein, a descender formed in the substrate and fluidically connected to the fluid pumping chamber, and a nozzle formed in the substrate and fluidically connected to the descender. An actuator can be in pressure communication with the fluid pumping chamber and can be capable of generating a firing pulse for causing ejection of a fluid droplet from the nozzle, the firing pulse having a firing pulse frequency. A recirculation passage can be formed in the substrate and configured to have an impedance at the firing pulse frequency substantially higher than the impedance of the nozzle.

In another aspect, an apparatus for fluid droplet ejection can include a substrate having a fluid pumping chamber formed therein, an actuator in pressure communication with the fluid pumping chamber and capable of generating a firing pulse for causing droplet ejection from the nozzle, the firing pulse having a firing pulse width, and a descender formed in the substrate and fluidically connected to the fluid pumping chamber. A nozzle can be formed in the substrate and fluidically connected to the descender. A recirculation passage can be formed in the substrate and fluidically connected to the descender, the recirculation passage having a length that is substantially equal to the firing pulse width multiplied by a speed of sound in a fluid divided by two.

Implementations can include one or more of the following features. A pump can be configured to maintain a predetermined height difference between a height of fluid in the fluid supply tank and a height of fluid in the fluid return tank, and the predetermined height difference can be selected to cause a flow of fluid through the substrate at a flow rate sufficient to force air bubbles or contaminants through the fluid pumping chamber, the descender, and the recirculation passage. A system can be configured with no pump fluidically connected between the substrate and the fluid supply tank. A system can also be configured with no pump fluidically connected between the substrate and the fluid return tank. The ratio of a flow rate through the recirculation passage (expressed in picoliters per second) to an area of the outlet (expressed in square microns) can be at least about 10. In some implementations, the area of the outlet can be about 156 square microns and the flow rate through the recirculation passage can be at least about 1500 picoliters per second. A distance between the outer substrate surface and a closest surface of the recirculation passage can be less than about 10 times a width of the outlet. In some implementations, the width of the outlet can be about 12.5 microns and the distance between the outer substrate surface and the closest surface of the recirculation passage can be less than about 60 microns. A system can further include a degasser positioned to remove air from the flow of fluid through the substrate. A system can also further include a filter positioned to remove contaminants from a flow of fluid through the substrate. A system can also further include a heater positioned to heat a flow of fluid through the substrate.

Further, two recirculation passages can be configured for fluid to flow from the descender to each of the two recirculation passages. Two recirculation passages can be configured for fluid to flow from one of the two recirculation passages through the descender to another of the two recirculation passages. Dimensions of the two recirculation passages can be about equal to one another.

In some implementations, each descender has only a single recirculation passage fluidically connected therewith. The impedance of the recirculation passage at the firing pulse frequency can be at least two times higher than the impedance of the nozzle, such as at least ten times higher than the impedance of the nozzle. The impedance of the recirculation passage at the firing pulse frequency can be sufficiently high to prevent a loss of energy from the firing pulse through the recirculation passage that would significantly detract from the pressure applied to the fluid in the nozzle. A firing pulse frequency can have a firing pulse width, and the length of the recirculation passage can be substantially equal to the firing pulse width multiplied by a speed of sound in the fluid divided by two. A cross-sectional area of the recirculation passage can be smaller than a cross-sectional area of the descender, such as less than about one tenth the cross-sectional area of the descender. An apparatus can also include a recirculation channel formed in the substrate and in fluid communication with the recirculation passage, and a transition in cross-sectional area between the recirculation passage and the recirculation channel can include sharp angles.

In some embodiments, the devices may include one or more of the following advantages. Circulating fluid in close proximity to the nozzle and outlet can prevent contaminants from interfering with fluid droplet ejection and prevent ink from drying in the nozzle. Circulation of deaerated fluid can clear aerated fluid from the fluid pressure path and can remove or dissolve air bubbles. Where the apparatus comprises multiple nozzles, removal of bubbles and aerated ink can promote uniform fluid droplet ejection. Further, use of a recirculation passage with high impedance at the firing pulse frequency can minimize the energy that is lost through the recirculation passage and can reduce the time required to refill the nozzle after fluid droplet ejection. Also, uniform arrangement of recirculation passages with respect to each nozzle can facilitate proper alignment of the nozzles. Symmetrical arrangement of recirculation passages around a nozzle can reduce or eliminate deflection of fluid droplet ejection that may otherwise be caused by the presence of a single recirculation passage or recirculation passages that are not symmetrically arranged around a nozzle. The described systems can be self-priming. Further, a system with a fluid supply tank and a fluid return tank, with a pump between these tanks, can isolate the pressure effects of the pump from the remainder of the system, such as the flow path body, thereby facilitating delivery of fluid without pressure pulses that are usually caused by a pump.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Fluid droplet ejection can be implemented with a substrate including a fluid flow path body, a membrane, and a nozzle layer. The flow path body has a fluid flow path formed therein, which can include a fluid pumping chamber, a descender, a nozzle having an outlet, and a recirculation passage. The fluid flow path can be microfabricated. An actuator can be located on a surface of the membrane opposite the flow path body and proximate to the fluid pumping chamber. When the actuator is actuated, the actuator imparts a firing pulse to the fluid pumping chamber to cause ejection of a droplet of fluid through the outlet. The recirculation passage can be fluidically connected to the descender in close proximity to the nozzle and the outlet, such as flush with the nozzle. Fluid can be constantly circulated through the flow path and fluid that is not ejected out of the outlet can be directed through the recirculation passage. Frequently, the flow path body includes multiple fluid flow paths and nozzles.

A fluid droplet ejection system can include the substrate described. The system can also include a source of fluid for the substrate as well as a return for fluid that is flowed through the substrate but is not ejected out of the nozzles of the substrate. A fluid reservoir can be fluidically connected to the substrate for supplying fluid, such as ink, to the substrate for ejection. Fluid flowing from the substrate can be directed to a fluid return tank. The fluid can be, for example, a chemical compound, a biological substance, or ink.

Figure 1A:
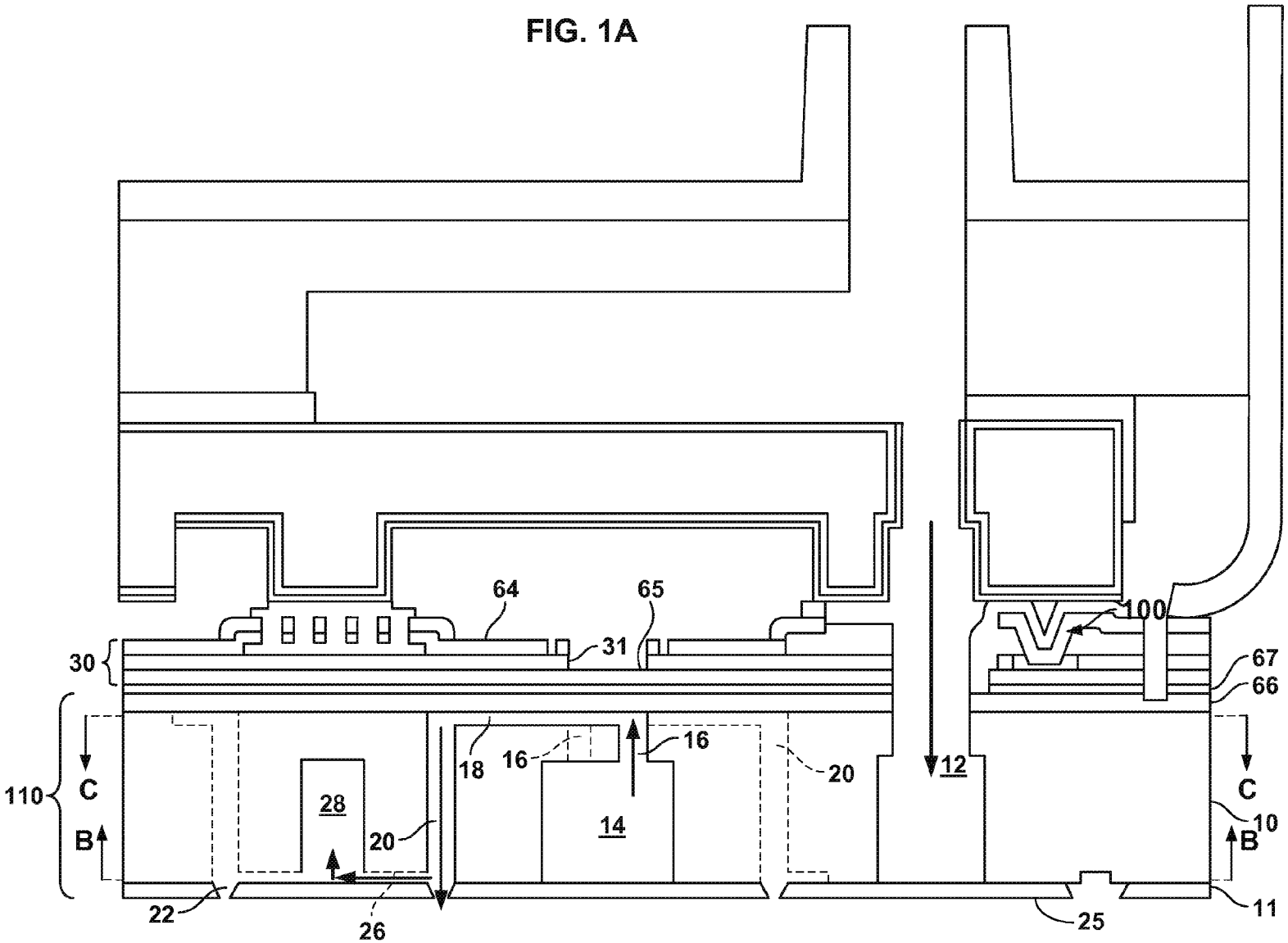
FIG. 1A is a cross-sectional side view of a portion of a printhead.

Referring to FIG. 1A, a cross-sectional schematic diagram of a portion of a printhead 100 in one implementation is shown. The printhead 100 includes a substrate 110. The substrate 110 includes a fluid path body 10, a nozzle layer 11, and a membrane 66. A substrate inlet 12 supplies a fluid inlet passage 14 with fluid. The fluid inlet passage 14 is fluidically connected to an ascender 16. The ascender 16 is fluidically connected to a fluid pumping chamber 18. The fluid pumping chamber 18 is in close proximity to a actuator 30. The actuator 30 can include a piezoelectric layer 31, such as a layer of lead zirconium titanate (PZT), an electrical trace 64, and a ground electrode 65. An electrical voltage can be applied between the electrical trace 64 and the ground electrode 65 of the actuator 30 to apply a voltage to the actuator 30 and thereby actuate the actuator 30. A membrane 66 is between the actuator 30 and the fluid pumping chamber 18. An adhesive layer 67 secures the actuator 30 to the membrane 66. Although the actuator 30 is shown as continuous in FIG. 1A, the piezoelectric layer 31 can be made non-continuous, such as by an etching step during fabrication. Also, while FIG. 1A shows various passages, such as a recirculation passage and an inlet passage, and the substrate inlet 12, these components may not all be in a common plane (and are not in a common plane in the implementation illustrated in FIGS. 1B and 1C). In some implementations, two or more of the fluid path body 10, the nozzle layer 11, and the membrane may be formed as a unitary body.

A nozzle layer 11 is secured to a bottom surface of the flow path body 10. A nozzle 22 having an outlet 24 is formed in an outer nozzle layer surface 25 of the nozzle layer 11. The fluid pumping chamber 18 is fluidically connected to a descender 20, which is fluidically connected to the nozzle 22 (see FIG. 2). The fluid pumping chamber 18, descender 20, and nozzle 22 may be herein collectively referred to as a fluid pressure path. For a square-shaped outlet 24, the length of the sides of the outlet 24 can be, for example, between about 5 microns and about 100 microns, such as about 12.5 microns. If the outlet 24 is other than square, the average width can be, for example, between about 5 microns and about 100 microns, such as about 12.5 microns. This outlet size can produce a useful fluid droplet size for some implementations.

A recirculation passage 26 is fluidically connected to the descender 20 at a location near the nozzle 22, as described in more detail below. The recirculation passage 26 is also fluidically connected to a recirculation channel 28, so that the recirculation passage 26 extends between the descender 20 and the recirculation channel 28. The recirculation channel 28 can have a larger cross-sectional area than the recirculation passage 26, and the change in the cross-sectional area can be abrupt rather than gradual. This abrupt change in cross-sectional area can facilitate minimizing energy loss through the recirculation passage 26, as described in more detail below. Further, the recirculation passage 26 can have a smaller cross-sectional area than the descender 20. For example, the cross-sectional area of the recirculation passage 26 can be less than one tenth, or less than one hundredth, the cross-sectional area of the descender 20. The ascender 16, fluid pumping chamber 18, descender 20, recirculation passage 26, and other features in the substrate can be microfabricated in some implementations.

Figure 1B:
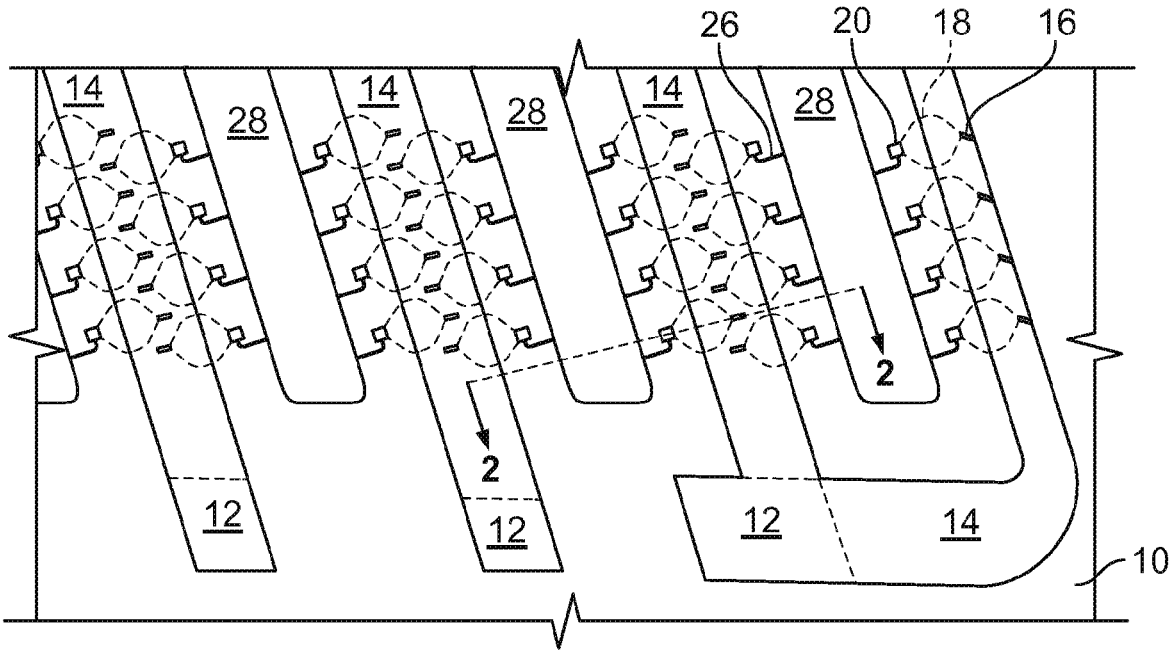
FIG. 1B is a cross-sectional plan view taken along line B-B in FIG. 1A and viewed in the direction of the arrows.
Figure 1C:
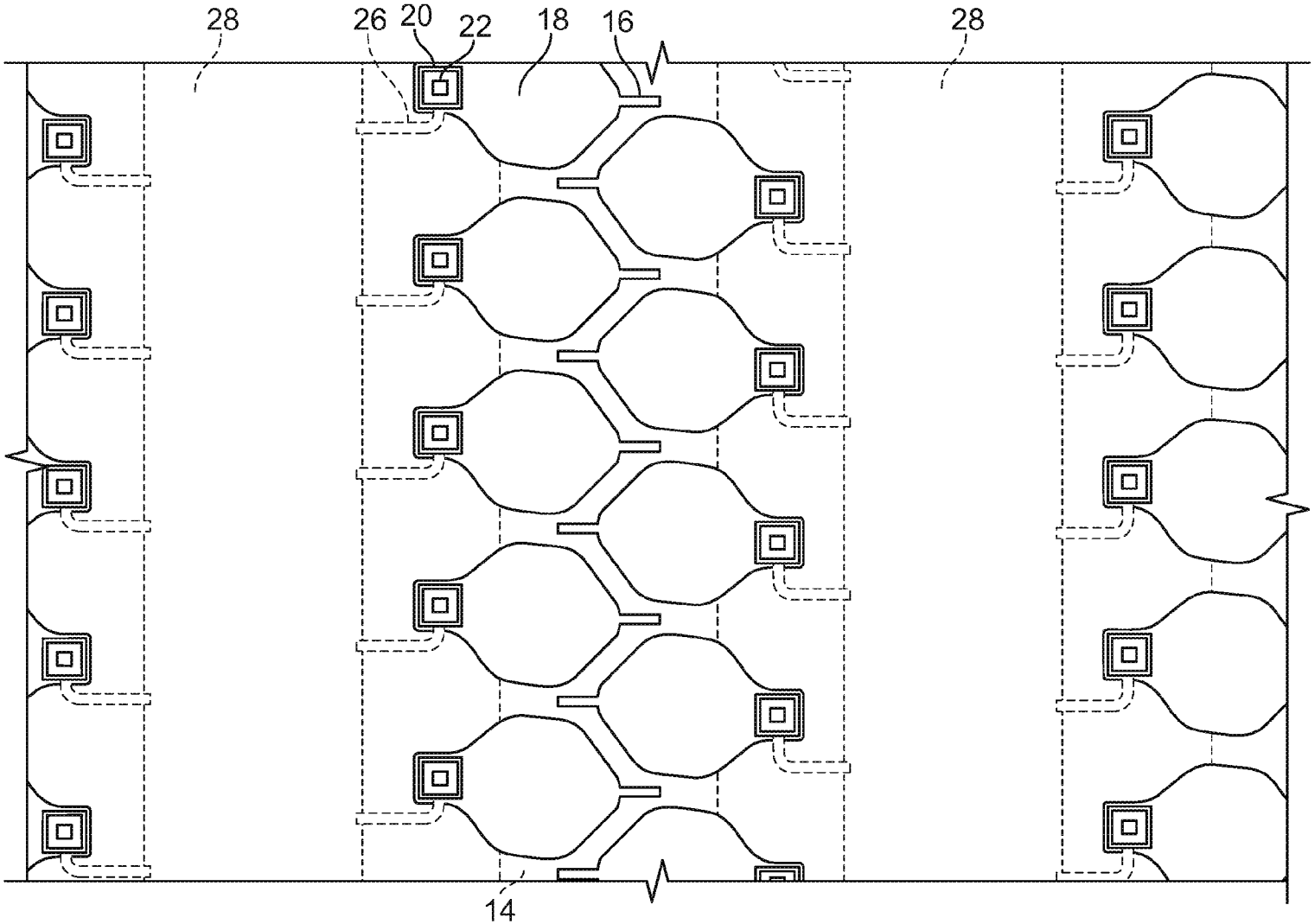
FIG. 1C is a cross-sectional plan view taken along line C-C in FIG. 1A and viewed in the direction of the arrows.

FIG. 1B is an illustrative cross-sectional diagram of a portion of the printhead 100 taken along line B-B in FIG. 1A. FIG. 1C is an illustrative cross-sectional diagram of a portion of the printhead 100 taken along line C-C in FIG. 1A. Referring to FIGS. 1B and 1C, the flow path body 10 includes multiple inlet passages 14 formed therein and extending parallel with one another. Multiple inlet passages 14 are in fluid communication with substrate inlets 12. The flow path body 10 also includes multiple recirculation channels 28 formed therein and in fluid communication with substrate outlets (not shown). The flow path body 10 also includes multiple ascenders 16, fluid pumping chambers 18, and descenders 20 formed therein. The ascenders 16 and the fluid pumping chambers 18 extend in parallel columns in an alternative pattern, and the descenders 20 also extend in parallel columns. Each ascender 16 is shown fluidically connecting an inlet passage 14 to a corresponding fluid pumping chamber 18, and each fluid pumping chamber 18 is shown fluidically connected to a corresponding descender 20. A recirculation passage 26 formed in the flow path body 10 fluidically connects each descender 20 to at least one corresponding recirculation channel 28. Referring to FIG. 1C, each descender 20 is shown with a corresponding nozzle 22. Each column of fluid pressure paths can be fluidically connected to a common inlet passage 14, and each fluid pressure path can have its own recirculation passage 26 separate from the other fluid pressure paths. This arrangement can provide uniform fluid flow in the same direction through each fluid pressure path (including through the recirculation passage 26) connected to the common inlet passage 14. This can prevent fluid ejection variations, for example, that are caused by having recirculation passages that are connected to neighboring fluid pressure paths (e.g., odd and even pressure paths). In some implementations, multiple flow path portions, each including a fluid pumping chamber 18, a descender 20, and a recirculation passage 26, can be fluidically connected in parallel between the fluid inlet passage 14 and the recirculation channel 28. That is, the multiple flow path portions can be configured to have no fluidical connection between one another (e.g., other than through the fluid inlet passage 14 or the recirculation channel 28). In some implementations, each flow path portion can also include an ascender 16.

Figure 2:
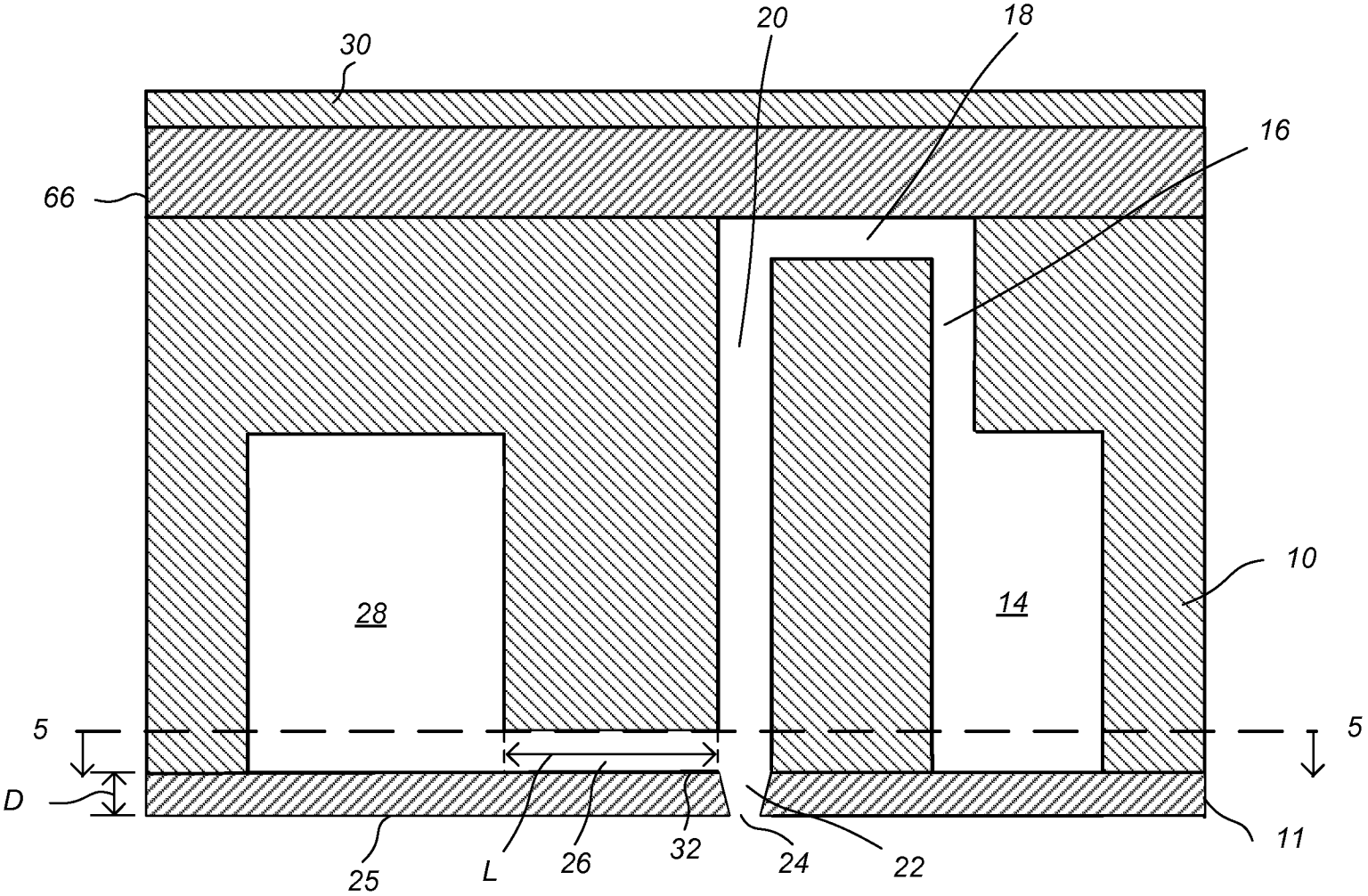
FIG. 2 is a cross-sectional side view taken along line 2-2 in FIG. 1B and viewed in the direction of the arrows.

FIG. 2 is an illustrative cross-sectional diagram taken along line 2-2 in FIG. 1B. The fluid inlet passage 14, ascender 16, fluid pumping chamber 18, descender 20, nozzle 22, and outlet 24 are arranged similar to FIG. 1A. The adhesive layer 67 is not shown for the sake of simplicity. The recirculation passage 26 has a passage surface 32 that is nearest the outer nozzle layer surface 25. The distance D between the outer nozzle layer surface 25 and the passage surface 32 can be less than about 10 times the width of the outlet 24, such as between about 2 and about 10 times the width of the outlet 24, e.g., between about 4.4 and 5.2 times, e.g. 4.8 times the width of outlet 24 (or average width of outlet 24 if outlet 24 is other than square). For example, for an outlet 24 with a width of 12.5 microns, the distance D can be less than or about 60 microns. As the outlet 24 is made larger, the recirculation passage 26 can be farther away from the outlet 24. The proximity between the recirculation passage 26 and the outlet 24 can facilitate removal of contaminants near the outlet 24, as described in more detail below. As another example, the nozzle 22 can be tapered in shape, and the passage surface 32 can be flush with a boundary of the nozzle 22 that is opposite the outlet 24. That is, the passage surface 32 can be immediately adjacent the taper of the nozzle 22, e.g. flush with the nozzle. FIG. 2 also shows that the recirculation passage 26 has a length L between the descender 20 and the recirculation channel 28. The length L can be selected to minimize loss of energy through the recirculation passage 26, as described below. In some implementations, the passage surface may be proximate the taper of the nozzle 22 but separated therefrom by a small distance, such as between about 5 microns and about 10 microns, to account for manufacturing limitations.

Figure 3A:
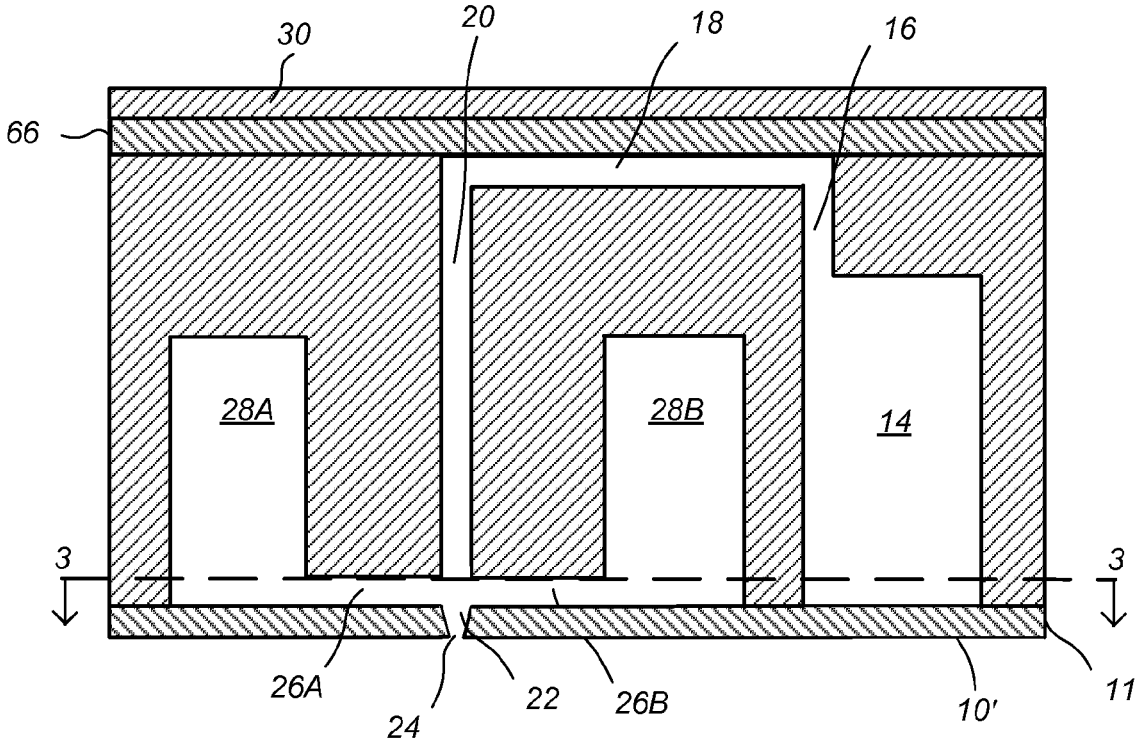
FIG. 3A is a cross-sectional side view of an alternative embodiment of a fluid ejection structure.

FIG. 3A is an illustrative cross-sectional diagram of a portion of an alternative flow path body 10'. The adhesive layer 67 is not shown for the sake of simplicity. The fluid inlet passage 14, ascender 16, fluid pumping chamber 18, descender 20, nozzle 22, and outlet 24 are arranged in a manner similar to the arrangement shown in FIG. 2. However, two recirculation passages 26A, 26B are fluidically connected to the descender 20. Each of the two recirculation passages 26A, 26B is fluidically connected to a corresponding recirculation channel 28A, 28B. The two recirculation passages 26A, 26B are arranged on opposite sides of the nozzle 22, and this arrangement can be symmetrical with respect to the descender 20. That is, the recirculation passages 26A, 26B are axially aligned with one another through a center of the descender 20. In some implementations, the recirculation passages 26A, 26B can be of equal cross-sectional size and equal length with respect to one another.

Figure 3B:
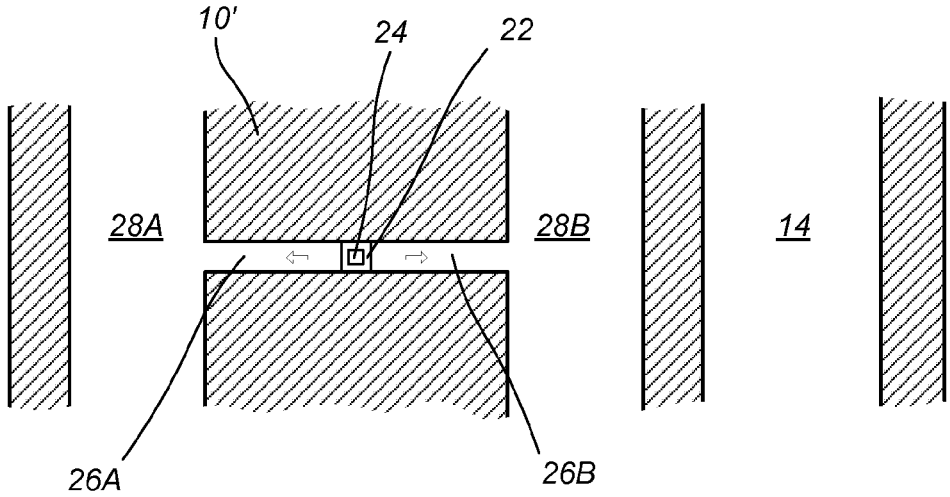
FIG. 3B is a cross-sectional plan view taken along line 3-3 in FIG. 3A and viewed in the direction of the arrows.

FIG. 3B is an illustrative cross-sectional view along line 3-3 in FIG. 3A. The square-shaped nozzle 22 and outlet 24 are visible, as are the fluid inlet passage 14 and the recirculation channels 28A and 28B. The recirculation passages 26A, 26B are arranged symmetrically around an axis through the center of the nozzle 22.

Figure 4:
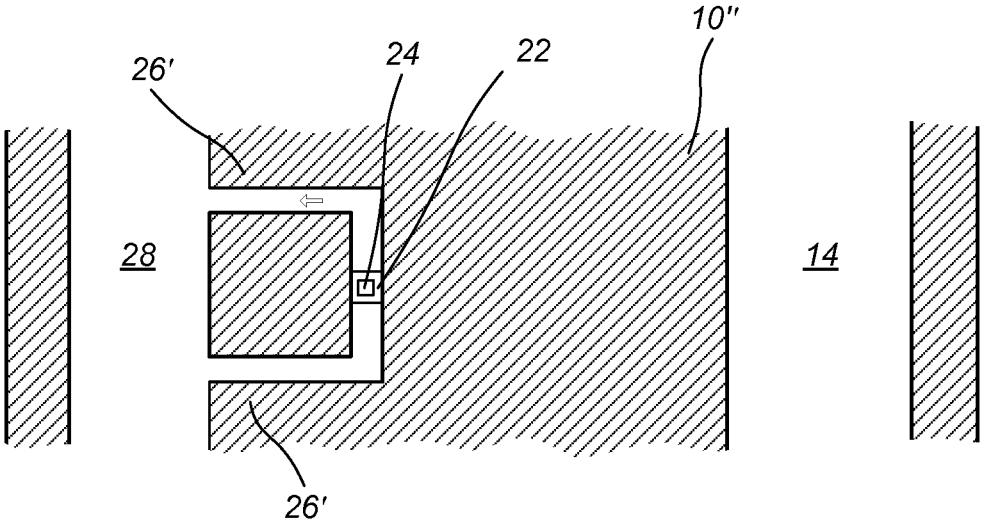
FIG. 4 is a cross-sectional plan view of an alternative embodiment of a fluid ejection structure.

FIG. 4 shows a portion of another alternative implementation of a flow path body 10". Two recirculation passages 26' are fluidically connected to the descender 20. Both of the recirculation passages 26' shown in FIG. 4 are fluidically connected to a common recirculation channel 28. Although the recirculation passages 26' are shown formed with a squared-off right angle in FIG. 4, the recirculation passages 26' can be formed with a curve or a series of curves, as shown, for example, with respect to the recirculation passages 26 in FIG. 1C.

Figure 5:
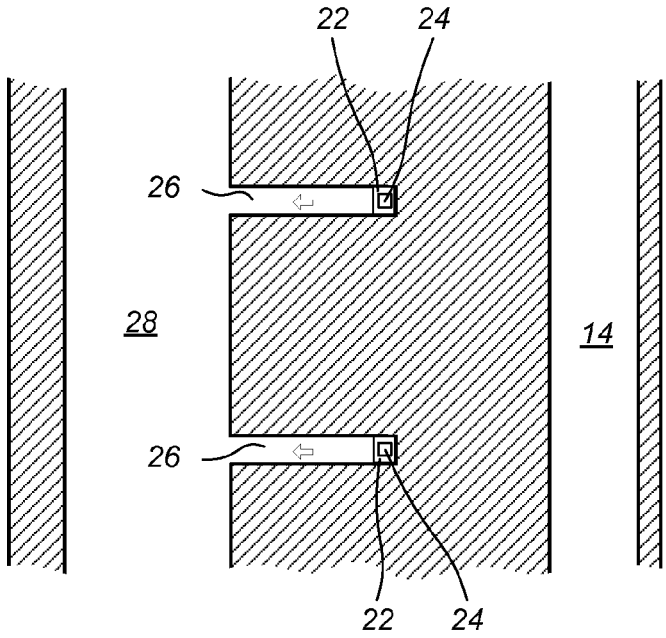
FIG. 5 is a cross-sectional plan view taken along line 5-5 in FIG. 2 and viewed in the direction of the arrows.

The above-described implementations can be employed in a series of nozzles 22 and outlets 24, and FIG. 5 illustrates two nozzles 22 and outlets 24 in an implementation where each nozzle 22 has one recirculation passage 26 extending therefrom. As described above with reference to FIG. 2, some implementations have the recirculation passage 26 for each nozzle 22 arranged on a same side of each corresponding nozzle with respect to the recirculation passages 26 corresponding to other nozzles 22. That is, each recirculation passage 26 for nozzles 22 in a row or column of nozzles 22 can extend in a same direction from the nozzle 22. FIG. 5 shows an implementation with an arrangement of recirculation passages 26 all extending from a same side of multiple nozzles 22. Such a uniform arrangement can facilitate uniformity of fluid droplet ejection among multiple nozzles 22. Without being limited to any particular theory, uniformity of fluid droplet ejection characteristics, such as ejection direction, is facilitated because any effect of the recirculation passages 26 on the pressure in the fluid pressure path is about the same for all of the nozzles 22. Thus, if any pressure changes or high pressure spots caused by the presence of the recirculation passages 26 cause ejected fluid droplets to be deflected in a direction away from normal to the outer nozzle layer surface 25, the effect will be the same for all nozzles 22. In some implementations, multiple recirculation passages 26 can be fluidically connected to a common recirculation channel 28.

Figure 6:
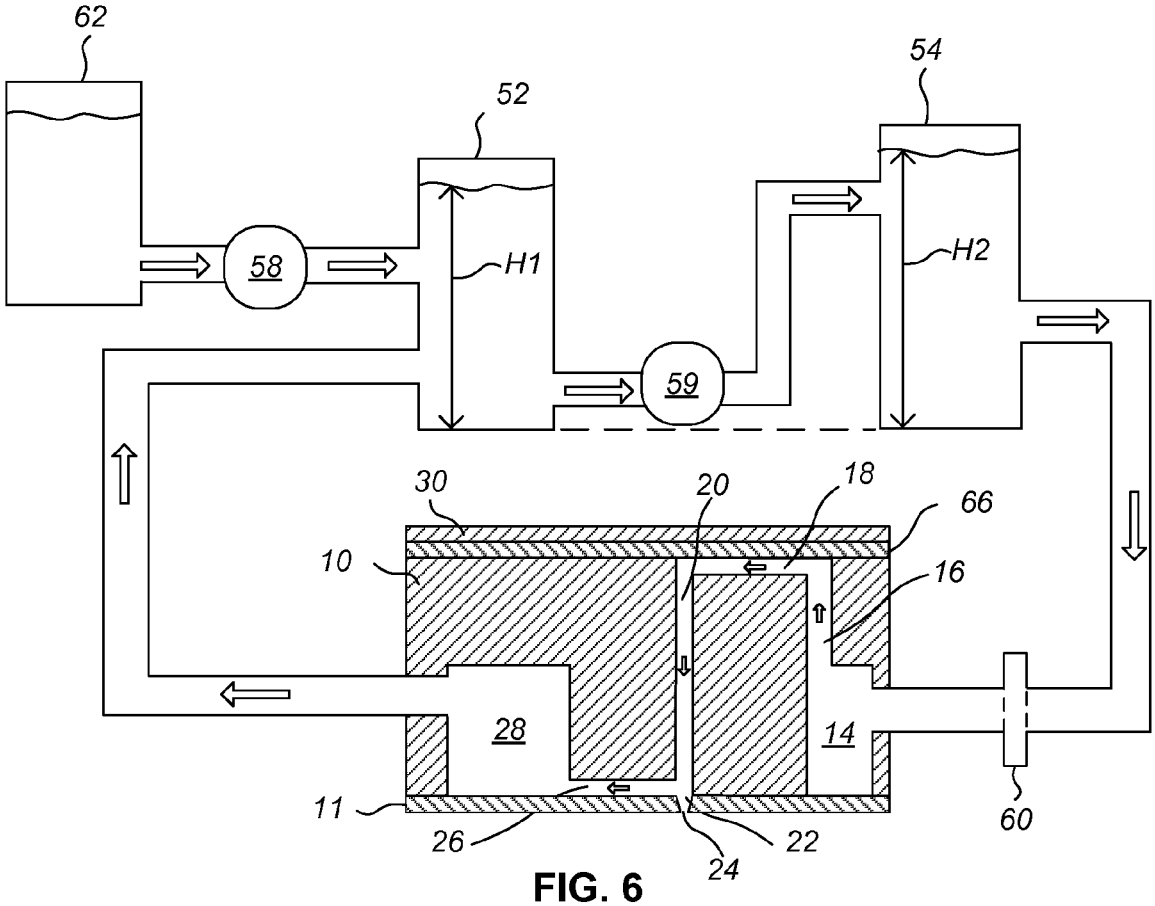
FIG. 6 is a schematic representation of a system for fluid recirculation.

Referring to FIG. 6, the printhead 100 described above is connected to an implementation of a fluid pumping system. Only a portion of the printhead 100 is shown for the sake of simplicity. The recirculation channel 28 is fluidically connected to a fluid return tank 52. A fluid reservoir 62 is fluidically connected to a reservoir pump 58 that controls a height of fluid in the fluid return tank 52, which can be referred to as the return height H1. The fluid return tank 52 is fluidically connected to a fluid supply tank 54 by a supply pump 59. The supply pump 59 controls a height of fluid in the fluid supply tank 54, which can be referred to as the supply height H2. Alternatively, in some implementations, the supply pump 59 can be configured to maintain a predetermined difference in height between the return height H1 and the supply height H2. The return height H1 and the supply height H2 are measured with respect to a common reference level, for example, as shown by a broken line between the fluid return tank 52 and the fluid supply tank 54 in FIG. 6. The fluid supply tank 54 is fluidically connected to the fluid inlet channel 14. In some implementations, the pressure at the nozzle 22 can be kept slightly below atmospheric, which can prevent or mitigate leakage of fluid or drying of fluid. This can be accomplished by having a fluid level of the fluid return tank 52 and/or the fluid supply tank 54 below the nozzle 22, or by reducing the air pressure over the surface of the fluid return tank 52 and/or the fluid supply tank 54 with a vacuum pump. The fluid connections between the components in the fluid pumping system can include rigid or flexible tubing.

A degasser 60 can be fluidically connected between the fluid supply tank 54 and the fluid inlet passage 14. The degasser 60 can alternatively be connected between the recirculation channel 28 and the fluid return tank 52, between the fluid return tank 52 and the fluid supply tank 54, or in some other suitable location. The degasser 60 can remove air bubbles and dissolved air from the fluid, e.g., the degasser 60 can deaerate the fluid. Fluid exiting the degasser 60 may be referred to as deaerated fluid. The degasser 60 can be of a vacuum type, such as a SuperPhobic® Membrane Contactor available from Membrana of Charlotte, N.C. Optionally, the system can include a filter for removing contaminants from the fluid (not shown). The system can also include a heater (not shown) or other temperature control device for maintaining the fluid at a desired temperature. The filter and heater can be fluidically connected between the fluid supply tank 54 and the fluid inlet passage 14. Alternatively, the filter and heater can be fluidically connected between the recirculation channel 28 and the fluid return tank 52, between the fluid return tank 52 and the fluid supply tank 54, or in some other suitable location. Also optional, a make-up section (not shown) can be provided to monitor, control, and/or adjust properties of or a composition of the fluid. Such a make-up section can be desirable, for example, where evaporation of fluid (e.g., during long periods of non-use, limited use, or intermittent use) may result in changes in a viscosity of the fluid. The make-up section can, for example, monitor the viscosity of the fluid, and the make-up section can add a solvent to the fluid to achieve a desired viscosity. The make-up section can be fluidically connected between the fluid supply tank 54 and the printhead 100, between the fluid return tank 52 and the fluid supply tank 54, within the fluid supply tank 54, or in some other suitable location.

In operation, the fluid reservoir 62 supplies the reservoir pump 58 with fluid. The reservoir pump 58 controls the return height H1 in the fluid return tank 52. The supply pump 59 controls the supply height H2 in the fluid supply tank 54. The difference in height between the supply height H2 and the return height H1 causes a flow of fluid through the degasser 60, the printhead 100, and any other components that are fluidically connected between the fluid supply tank 54 and the fluid return tank 52, and this flow of fluid can be caused without directly pumping fluid into or out of the printhead 100. That is, there is no pump between the fluid supply tank 54 and the printhead 100 or between the printhead 100 and the fluid return tank 52. Fluid from the fluid supply tank 54 flows through the degasser 60, through the substrate inlet 12 (FIG. 1), and into the fluid inlet passage 14. From the fluid inlet passage 14, fluid flows through the ascender 16 and into the fluid pumping chamber 18. Fluid then flows through the descender 20 and either to the outlet 24 or to the recirculation passage 26. A majority of the fluid flows from the region near the nozzle 22 through the recirculation passage 26 and into the recirculation channel 28. From the recirculation channel 28, fluid is able to flow back to the fluid return tank 52.

Where more than one nozzle 22 and outlet 24 are used in a droplet ejection apparatus, such as in the implementation shown in FIG. 5, the flow of fluid can be in the same direction in each of the recirculation passages 26. This uniformity of direction of flow between nozzles can promote uniformity of fluid droplet ejection characteristics between nozzles 22. Fluid droplet ejection characteristics include, for example, droplet size, ejection speed, and ejection direction. Without being limited to any particular theory, this uniformity of ejection characteristics can result from uniformity of any pressure effects caused by flow of fluid near the nozzles 22. Where each nozzle 22 is provided with two or more recirculation passages 26A, 26B, as in the implementation shown in FIGS. 3A and 3B, the flow directions of the fluid can be away from the nozzle 22 in both recirculation passages 26A and 26B. Alternatively, fluid can flow from one recirculation passage 26A to another recirculation passage 26B. Similarly, in the implementation shown in FIG. 4, the flow direction of the fluid can be away from the nozzle 22 in both recirculation passages 26'.

The presence of a recirculation passage 26 may cause droplet ejection from the outlet 24 to occur at an angle rather orthogonal to the outer nozzle layer surface 25. Without being limited to any particular theory, this deflection can result from a pressure imbalance near the nozzle 22 caused by fluid flow through the recirculation passage 26. Where more than one nozzle 22 and outlet 24 are used, the recirculation passage 26 for each nozzle can be on a same side of each nozzle 22, as shown in FIG. 5, so that any effects of the presence of the recirculation passage 26 are the same for each nozzle. Because any effects are the same for each nozzle, ejection from the nozzles 22 is uniform. Where each nozzle has two recirculation passages 26A, 26B as show in FIG. 4, the recirculation passages 26A, 26B can be arranged symmetrically around the nozzle 22. Without being limited to any particular theory, symmetrical arrangement of recirculation passages 26A, 26B can result in equal and opposite effects that cancel one another out.

Flow of deaerated fluid near the nozzle 22 can prevent drying of the fluid near the outlet 24, where the fluid is typically exposed to air. Air bubbles and aerated fluid may also remain from priming or may have entered through an outlet 24 or elsewhere. Air bubbles and their effects in a fluid droplet ejection system are discussed in more detail below. In some implementations, the fluid flowing through the fluid inlet passage 14 has been at least partially cleared of air bubbles and dissolved air by the degasser 60. Flow of deaerated fluid near the nozzle 22 can remove air bubbles and aerated fluid near the nozzle 22 and outlet 24 by replacing aerated fluid with deaerated fluid. If the fluid is ink, agglomerations of ink or pigment may form where ink has been stagnant or exposed to air. Fluid flow can remove agglomerations of ink or pigment from the flow path body that might otherwise interfere with fluid droplet ejection or serve as nucleation sites for air bubbles. Fluid flow can also reduce or prevent settling of pigment in ink.

In some implementations, a flow rate through the recirculation passage 26 can be sufficiently high to mitigate or prevent the fluid from drying near the outlet 24. An evaporation rate of the fluid near the outlet 24 is proportional to the area of the outlet 24. For example, the evaporation rate of the fluid can double if the area of the outlet 24 doubles. To mitigate or prevent drying of fluid when the system is operating, the numerical magnitude of the flow rate through the recirculation passage 26, as expressed in picoliters per second, can be at least 1 or more times greater (e.g., 2 or more times greater, 5 or more times greater, or 10 or more times greater) than the numerical magnitude of the area of the outlet 24, as expressed in square microns, in some implementations. The flow rate also depends on the type of fluid being used. For example, if the fluid is a relatively fast-drying fluid, then the flow rate can be increased to compensate for this, and conversely, the flow rate can be slower for a relatively slow-drying fluid. For example, for a square-shaped outlet 24 measuring 12.5 microns on each side, the flow rate can be at least 1500 picoliters per second (e.g., at least 3000 picoliters per second). This flow rate can be an order of magnitude greater, e.g., 10 or more times greater, than the flow rate required to provide adequate fluid for ejection through the outlet 24 during normal fluid droplet ejection. However, this flow rate can also be much less than the flow rate at maximum operating frequency. For example, if the maximum fluid droplet ejection frequency is 30 kHz and the volume of each drop ejected is 5 picoliters, then the flow rate at the maximum operating frequency is about 150,000 picoliters per sec. The flow of deaerated fluid can pass in close proximity to the nozzle 22 and outlet 24, as discussed with reference to FIG. 2, above. The flow rate just described can prevent drying of fluid and can sweep away air bubbles, debris, and other contaminants that might otherwise settle in the nozzle 22 at a lower flow rate.

Recirculation of fluid reduces or eliminates the need to perform various purging or cleaning activities that might otherwise be required, such as ejecting fluid, suctioning air bubbles and aerated fluid from the nozzle 22 using an external apparatus, or otherwise forcing or drawing air out of the nozzles 22. Such techniques can require an external apparatus to interface with the nozzle 22, thereby interrupting droplet deposition and reducing productivity. Instead, the above-described flow of deaerated fluid in close proximity to the nozzle 22 can remove air bubbles and aerated fluid without the need for an external apparatus to interface with the nozzle 22. Therefore, when the flow path body 10 is empty of fluid, such as when the above-described system is first being filled with fluid, the system can be "self-priming" by flowing fluid through the flow path body 10. That is, in some implementations, the above-described system can purge air from the flow path body 10 by circulating fluid instead of, or in addition to, forcing or drawing air out of the nozzle 22.

The flow of fluid described above is not, in some implementations, sufficient to cause fluid to be ejected from the outlet 24. An actuator, such as a piezoelectric transducer or a resistive heater, is provided adjacent to the fluid pumping chamber 18 or the nozzle 24 and can effect droplet ejection. The actuator 30 can include a piezoelectric layer 31, such as a layer of lead zirconium titanate (PZT). Electrical voltage applied to the piezoelectric layer 31 can cause the layer to change in shape. If a membrane 66 (see FIG. 1) between the actuator 30 and the fluid pumping chamber 18 is able to move due to the piezoelectric layer 31 changing in shape, then electrical voltage applied across the actuator 30 can cause a change in volume of the fluid pumping chamber 18. This change in volume can produce a pressure pulse, which is herein referred to as a firing pulse. A firing pulse can cause a pressure wave to propagate through the descender 20 to the nozzle 22 and outlet 24. A firing pulse can thereby cause ejection of fluid from the outlet 24.

Air bubbles are generally much more compressible than the fluid being circulated through the above-described system. Therefore, air bubbles can absorb a substantial amount of the energy of the firing pulse if present in the fluid pumping chamber 18, descender 20, or nozzle 22. If air bubbles are present, instead of a change in volume of the fluid pumping chamber 18 causing a proper amount of fluid ejection through the nozzle 22, the change in volume can instead be at least partially absorbed by compression of air bubbles. This can result in insufficient pressure at the nozzle 22 for causing ejection of droplets of fluid through outlet 24, or a smaller than desired droplet may be ejected, or a droplet may be ejected at a slower than desired speed. Greater electrical voltage can be applied to the actuator 30, or a larger fluid pumping chamber 18 can be used, to provide sufficient energy to achieve more complete fluid droplet ejection, but size and energy requirements of system components would be increased. Further, where the apparatus includes multiple nozzles, the presence of more air bubbles in some fluid pressure paths as compared to others, for example, may cause non-uniformity in fluid droplet ejection characteristics from nozzle to nozzle.

Flowing deaerated fluid through the fluid pressure path can remove air bubbles and aerated fluid. Aerated fluid, i.e., fluid containing dissolved air, is more likely to form air bubbles than deaerated fluid. Removal of aerated fluid can thus help to reduce or eliminate the presence of air bubbles. Reducing or eliminating the presence of air bubbles can, as discussed above, help to minimize the electrical voltage that must be applied to the actuator 30. The necessary size of the fluid pumping chamber 18 can similarly be minimized. Inconsistencies in droplet ejection among multiple nozzles due to the presence of air bubbles can also be reduced or eliminated.

Although having a recirculation passage 26 fluidically connected to the descender 20 can facilitate removal of air bubbles and other contaminants, the recirculation passage 26 presents a path through which the energy applied by the actuator 30 may be diminished. This loss of energy detracts from the pressure applied to the fluid in the nozzle 22 and at the outlet 24. If this loss of energy significantly detracts from the pressure applied, greater electrical voltage may then need to be applied to the actuator 30, or a larger fluid pumping chamber 18 may need to be provided, for sufficient energy to reach the nozzle 22. By designing the recirculation passage 26 with an impedance much higher than the impedance of the descender 20 and the nozzle 22 at the firing pulse frequency, less energy is needed to compensate for energy losses through the recirculation passage 26. For example, the impedance of the recirculation passage 26 can be greater than the impedance of the descender 20 and the nozzle 22, such as two times or more, five times or more, or ten times or more.

An impedance higher than that of the descender 20 and the nozzle 22 can be achieved in part by providing the recirculation passage 26 with a smaller cross-sectional area than that of the descender 20. Further, an abrupt change in impedance between the recirculation passage 26 and the recirculation channel 28 can facilitate reflection of pressure pulses in the recirculation passage 26. The recirculation channel 28 can have an impedance lower than that of the recirculation passage 26, and the change in impedance between the recirculation passage 26 and the recirculation channel 28 can be abrupt to maximize reflection of pressure pulses. For example, an abrupt change in impedance can be caused by sharp angles, such as right angles, at the transition between the recirculation passage 26 and the recirculation channel 28. This abrupt change in impedance can cause reflection of pressure pulses where the cross-sectional area changes at the boundary between the recirculation passage 26 and the recirculation channel 28.

Figure 7A:
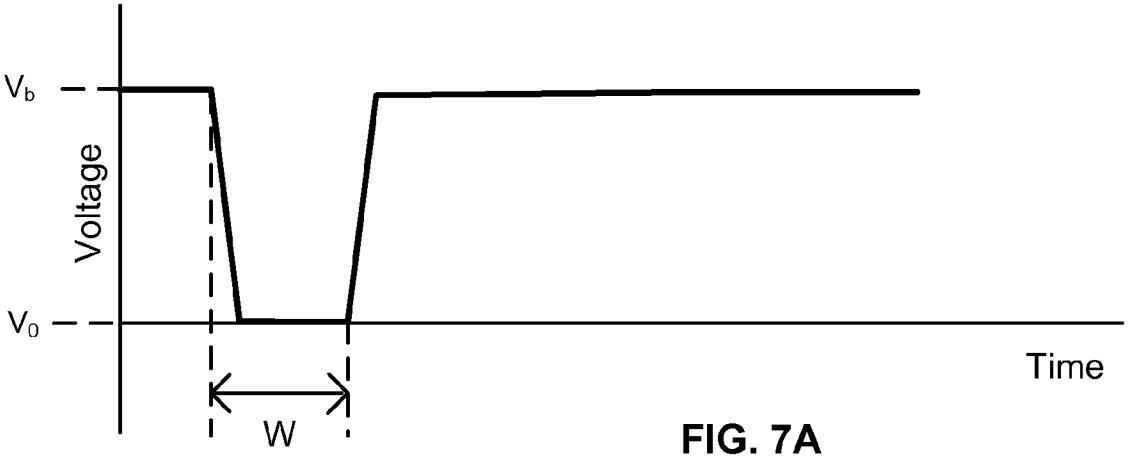
FIG. 7A is a graph representing a firing pulse.
Figure 7B:
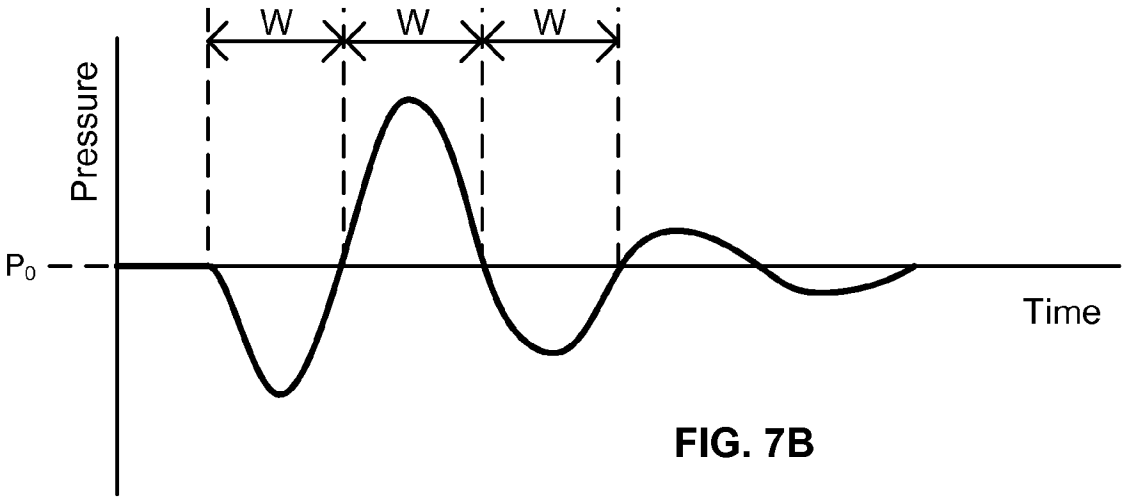
FIG. 7B is a graph representing a pressure response to the firing pulse shown in FIG. 7A.

FIG. 7A shows a graph of voltage applied across an actuator 30 over time. When the actuator 30 is not firing, a bias voltage $V_b$ exists across the actuator 30. FIG. 7B shows a graph of pressure in the fluid pumping chamber 18 over time. Referring to FIG. 7A, the firing pulse has a firing pulse width, W. This firing pulse width W is a length of time approximately defined by a drop in voltage to a lower voltage $V_0$ and a dwell at the lower voltage $V_0$. Circuitry (not shown) in electrical communication with the actuator 30 can include drivers configured to control the shape of the firing pulse, including the firing pulse frequency and the size of the firing pulse width W. The circuitry can also control timing of the firing pulse. The circuitry can be automatic or can be controlled manually, such as by a computer with computer software configured to control fluid droplet ejection, or by some other input. In alternative embodiments, the firing pulse may not include a bias voltage $V_b$. In some embodiments, the firing pulse may include an increase in voltage, both an increase in voltage and a decrease in voltage, or some other combination of changes in voltage.

Referring to FIG. 7B, the firing pulse causes a fluctuation in pressure in the fluid pumping chamber 18 with a frequency corresponding to the firing pulse frequency. The pressure in the fluid pumping chamber 18 first drops below normal pressure $P_0$ for a period of time corresponding to the firing pulse width W. The pressure in the fluid pumping chamber 18 then oscillates above and below normal pressure $P_0$ with diminishing amplitude until the pressure in the fluid pumping chamber returns to normal pressure $P_0$ or until the actuator 30 again applies pressure. The amount of time that the pressure is above or below normal pressure $P_0$ during each oscillation of the pressure in the fluid pumping chamber 18 corresponds with the firing pulse width W. The firing pulse width W can depend on a particular fluid path design (e.g., dimensions of the fluid pressure path, such as size of the pumping chamber 18, and whether the fluid path includes an ascender 16 or descender 20) and/or the drop volume being ejected. For example, as a pumping chamber decreases in size, the resonant frequency of the pumping chamber increases, and therefore the width of the firing pulse can decrease. For a pumping chamber ejecting a drop volume of about 2 picoliters, the pulse width, W, can be, for example, between about 2 microseconds and about 3 microseconds, and for a pumping chamber 18 that effects ejection of a drop volume of about 100 picoliters, the pulse width W can be between about 10 and about 15 microseconds.

The length L of the recirculation passage 26 (see FIG. 2) can be configured such that at the speed of sound in the fluid, c, the time required for a pressure pulse to travel twice the length L is approximately equal to the firing pulse width W. This relationship can be expressed as follows:

$$\frac{2 \cdot L}{c} \cong W$$

If the fluid is ink, the speed of sound, c, is typically about 1100-1700 meters per second. If the firing pulse width W is between about 2 microseconds and about 3 microseconds, the length L can be about 1.5 millimeters to about 2.0 millimeters.

Selecting the length L to satisfy the above relationship can provide the recirculation passage 26 with a higher impedance than if L did not satisfy this relationship. Without being limited to any particular theory, selecting the length L to satisfy the above relationship causes the pressure pulses from the actuator 30 that propagate down the recirculation passage 26 to be reflected back to the descender 20 at a time that reinforces the firing pulse.

Further, selecting the length L as described above can reduce resistance to refilling of the nozzle 22 with fluid. Upon refilling of the nozzle 22, a meniscus forms at the outlet 24. During and after refilling of the nozzle 22, the shape of this meniscus can change and oscillate, potentially resulting in inconsistent direction of fluid droplet ejection. Selecting the length L as described above can improve refilling of the nozzle 22 and reduce a necessary amount of meniscus settling-out time. Reducing an amount of time required for stabilization of the meniscus can reduce an amount of settling time required between fluid droplet ejections. Thus, with a proper length L of the recirculation passage 26, fluid droplet ejection can occur at faster speeds, that is, with more ejections during a given period of time, which may also be referred to as higher frequency.

The above-described implementations can provide none, some, or all of the following advantages. Circulation of fluid in close proximity to the nozzle and outlet can prevent drying of the fluid and prevent accumulation of contaminants that could interfere with fluid droplet ejection. Circulation of deaerated fluid can clear aerated fluid from the fluid pressure path and can remove or dissolve air bubbles. A high flow rate of fluid can aid in dislodging and removing, and preventing the accumulation of, small air bubbles and other contaminants. Where the fluid is ink with pigment, a high flow rate of fluid can prevent pigment from settling or agglomerating. Removing air bubbles and aerated fluid can prevent bubbles from absorbing energy from the firing pulse. Where the apparatus includes multiple nozzles, the absence of air bubbles and aerated fluid can promote uniform fluid droplet ejection. Further, using a recirculation passage with high impedance at the firing pulse frequency minimizes the energy that is lost through the recirculation passage. Higher efficiency can thereby be obtained. Proper selection of the length of the recirculation passage can reduce meniscus settling-out time and reduce the time required to refill the nozzle after fluid droplet ejection. Also, uniform arrangement of recirculation passages with respect to each nozzle can promote uniformity of fluid droplet ejection direction, thereby facilitating proper alignment of the nozzles. In an alternative embodiment, symmetrical arrangement of recirculation passages can reduce or eliminate deflection of ejection direction and thereby remove the need for any droplet ejection timing compensation or other compensation. The above-described systems can be self-priming. Further, a system with a fluid supply tank and a fluid return tank, with a pump between these tanks, can isolate the pressure effects of the pump from the remainder of the system, thereby facilitating delivery of fluid without pressure pulses that are usually caused by a pump.

Although the invention has been described herein with reference to specific embodiments, other features, objects, and advantages of the invention will be apparent from the description and the drawings. All such variations are included within the intended scope of the invention as defined by the following claims.

What is claimed is:

1. An apparatus for ejecting droplets of a fluid, comprising:

a substrate having a fluid pumping chamber formed therein;

a descender formed in the substrate and fluidically connected to the fluid pumping chamber;

an actuator in pressure communication with the fluid pumping chamber;

a nozzle formed in the substrate and fluidically connected to the descender, the nozzle having an outlet for ejecting droplets of fluid, the outlet being formed in an outer substrate surface; and a recirculation passage formed in the substrate and fluidically connected to the descender at a position such that a distance between the outer substrate surface and a closest surface of the recirculation passage is less than or about 10 times a width of the outlet, and the recirculation passage is not fluidically connected to a different fluid pumping chamber.

2. The apparatus of claim 1, wherein the width of the outlet is about 12.5 microns and the distance between the outer substrate surface and the closest surface of the recirculation passage is less than or about 60 microns.

3. The apparatus of claim 1, wherein a ratio of a flow rate of fluid through the recirculation passage (expressed in picoliters per second) to an area of the outlet (expressed in square microns) is at least about 10.

4. The apparatus of claim 3, wherein the area of the outlet is about 156 square microns and the flow rate of fluid through the recirculation passage is at least about 1500 picoliters per second.

5. An apparatus for ejecting droplets of a fluid, comprising:

a substrate having a fluid pumping chamber formed therein;

a descender formed in the substrate and fluidically connected to the fluid pumping chamber;

a nozzle formed in the substrate and fluidically connected to the descender;

an actuator in pressure communication with the fluid pumping chamber and capable of generating a firing pulse for causing ejection of a fluid droplet from the nozzle, the firing pulse having a firing pulse frequency; and a recirculation passage formed in the substrate and configured to have an impedance at the firing pulse frequency substantially higher than an impedance of the nozzle.

6. The apparatus of claim 5, wherein the impedance of the recirculation passage at the firing pulse frequency is at least two times higher than the impedance of the nozzle.

7. The apparatus of claim 5, wherein the impedance of the recirculation passage at the firing pulse frequency is at least ten times higher than the impedance of the nozzle.

8. The apparatus of claim 5, wherein the impedance of the recirculation passage at the firing pulse frequency is sufficiently high to prevent a loss of energy from the firing pulse through the recirculation passage that would significantly detract from the pressure applied to the fluid in the nozzle.

9. The apparatus of claim 5, wherein the firing pulse frequency has a firing pulse width, and a length of the recirculation passage is substantially equal to the firing pulse width multiplied by a speed of sound in the fluid divided by two.

10. The apparatus of claim 5, wherein a cross-sectional area of the recirculation passage is smaller than a cross-sectional area of the descender.

11. The apparatus of claim 10, wherein the cross sectional area of the recirculation passage is less than about one tenth the cross-sectional area of the descender.

12. The apparatus of claim 5, further comprising:

a recirculation channel formed in the substrate and in fluid communication with the recirculation passage, wherein a transition in cross-sectional area between the recirculation passage and the recirculation channel includes sharp angles.

* * * * *